US010012074B2

(12) United States Patent
Pomerantz et al.

(10) Patent No.: US 10,012,074 B2
(45) Date of Patent: Jul. 3, 2018

(54) ASPHALTENE CONTENT OF HEAVY OIL

(71) Applicant: Schlumberger Technology Corporation, Sugar Land, TX (US)

(72) Inventors: Andrew E. Pomerantz, Lexington, MA (US); Zied Ben Hamad, Paris (FR); Albert Ballard Andrews, Wilton, CT (US); Youxiang Zuo, Burnaby (CA); Oliver Clinton Mullins, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 498 days.

(21) Appl. No.: 14/371,987

(22) PCT Filed: Jan. 11, 2013

(86) PCT No.: PCT/US2013/021274
§ 371 (c)(1),
(2) Date: Jul. 11, 2014

(87) PCT Pub. No.: WO2013/106736
PCT Pub. Date: Jul. 18, 2013

(65) Prior Publication Data

US 2015/0000902 A1 Jan. 1, 2015

Related U.S. Application Data

(60) Provisional application No. 61/585,934, filed on Jan. 12, 2012.

(51) Int. Cl.
*E21B 49/00* (2006.01)
*E21B 47/10* (2012.01)
(Continued)

(52) U.S. Cl.
CPC ..... *E21B 49/00* (2013.01); *E21B 47/102* (2013.01); *E21B 49/081* (2013.01); *E21B 49/10* (2013.01)

(58) Field of Classification Search
None
See application file for complete search history.

(56) References Cited

U.S. PATENT DOCUMENTS 4,860,581 A 8/1989 Zimmerman et al.
5,331,156 A 7/1994 Hines et al.
(Continued)

FOREIGN PATENT DOCUMENTS

EP 1686237 A1 8/2006
GB 2409902 A 7/2005
(Continued)

OTHER PUBLICATIONS

Lopez, et al., "A New Multifunctional Ferrocenyl-Substituted Ferrocenophane Derivative: Optical and Electronic Properties and Selective Recognition of Mg2+ Ions", Apr. 2, 2004, Chemistry—A European Journal, vol. 10, No. 7, pp. 1815-1826.
(Continued)

*Primary Examiner* — Shawn Decenzo
(74) *Attorney, Agent, or Firm* — Michael Dae

(57) ABSTRACT

A downhole tool is conveyed within a borehole extending into a subterranean formation. Fluid is drawn from the subterranean formation into the downhole tool, wherein the fluid comprises heavy oil. Fluorescence intensity of the drawn fluid is measured via a sensor of the downhole tool, and asphaltene content of the drawn fluid is estimated based on the measured fluorescence intensity.

18 Claims, 5 Drawing Sheets

(51) Int. Cl.
*E21B 49/10* (2006.01)
*E21B 49/08* (2006.01)

(56) References Cited

U.S. PATENT DOCUMENTS

| | | | | |
|---|---|---|---|---|
| 6,002,063 | A * | 12/1999 | Bilak | B09B 1/00 588/17 |
| 6,476,384 | B1 | 11/2002 | Mullins et al. | |
| 6,758,090 | B2 | 7/2004 | Bostrom et al. | |
| 7,002,142 | B2 | 2/2006 | Mullins et al. | |
| 7,434,457 | B2 | 10/2008 | Goodwin et al. | |
| 7,933,018 | B2 | 4/2011 | Vannuffelen et al. | |
| 8,271,248 | B2 | 9/2012 | Pomerantz et al. | |
| 2008/0037006 | A1* | 2/2008 | Canas Triana | E21B 47/102 356/73 |
| 2008/0066537 | A1 | 3/2008 | Hegeman et al. | |
| 2010/0192684 | A1* | 8/2010 | Wu | E21B 49/082 73/152.55 |
| 2010/0313647 | A1 | 12/2010 | Terabayashi et al. | |
| 2011/0005745 | A1 | 1/2011 | Goodwin | |
| 2011/0282628 | A1* | 11/2011 | Mark | G06F 17/18 702/179 |

FOREIGN PATENT DOCUMENTS

| | | | |
|---|---|---|---|
| GB | 2461555 | A | 1/2010 |
| RU | 2373523 | C2 | 11/2009 |
| WO | 2009093081 | A1 | 7/2009 |

OTHER PUBLICATIONS

Issa, et al., "Potentiometric measurement of state-of-charge of lead-acid battery by using a bridged ferrocene surface modified electrode", Aug. 25, 2006, Journal of Power Services, vol. 158, No. 2, pp. 1034-1038.

Ryder, "Time-Resolved Fluorescence Spectroscopic Study of Crude Petroleum Oils: Influence of Chemical Composition", Nov. 5, 2004, Applied Spectroscopy, Vo. 58, No. 5, pp. 613-623.

European Search Report issued in related EP application 13736425.3 dated Jun. 24, 2016, 5 pages.

Office Action issued in related EP application 13736425.3 dated Jul. 8, 2016, 5 pages.

Buenrostro-Gonzalez, et al. "The Overriding Chemical Principles that Define Asphaltenes," Energy Fuels, 2001, vol. 15, No. 4, pp. 972-978.

Burcaw, et al. "Improved Methods for Estimating The Viscosity of Heavy Oils From Magnetic Resonance Data," SPWLA 49th Annual Logging Symposium, Edinburgh, Scotland, May 25-28, 2008, pp. 1-14.

Lin, et al. "Chapter V, The Effects of Asphaltenes on the Chemical and Physical Characteristics of Asphalt," In Asphaltenes: Fundamentals and Applications, Eds. Sheu, E. Y., Mullins, O. C., Plenum Press: New York, 1995, pp. 155-176.

Pomerantz, et al. "Combining biomarker and bulk compositional gradient analysis to assess reservoir connectivity," Organic Geochemistry, 2010, vol. 41, pp. 812-821.

Wang, et al. "Fluorescence Lifetime Studies of Crude Oils," Applied Spectroscopy, 1994, vol. 48, No. 8, pp. 977-984.

International Search Report for International Application No. PCT/US2013/021274 dated Apr. 30, 2013.

International Preliminary Report on patentability issued in the related PCT application PCT/US2013/021274, dated Jul. 15, 2014 (9 pages).

Office Action issued in the related RU Application 2014133016, dated Mar. 24, 2017 (13 pages).

Office Action issued in the related MX Application MX/a/2014/008481, dated Oct. 27, 2017 (8 pages).

* cited by examiner

ASPHALTENE CONTENT OF HEAVY OIL

BACKGROUND OF THE DISCLOSURE

Reservoirs containing heavy oil (e.g., hydrocarbons having a viscosity above about 1500 cP at reservoir temperature and/or an asphaltene content above about 2% by weight) sometimes have compositional gradients. Where such reservoirs are thick (e.g., having a vertical extent exceeding 20 meters), the effect of the compositional gradients may be amplified. For example, the compositional gradients may cause changes in viscosity, temperature, asphaltene content, fluorescence intensity, and/or other parameters as a function of depth, perhaps changes having several orders of magnitude. Thus, downhole fluid analysis (DFA) utilizing optical spectroscopy may be performed. However, scattering caused by emulsified water, which can dominate the optical absorption, may complicate optical spectrometry with heavy oils. As a result, DFA answer products available for conventional oils may not be available for heavy oils.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
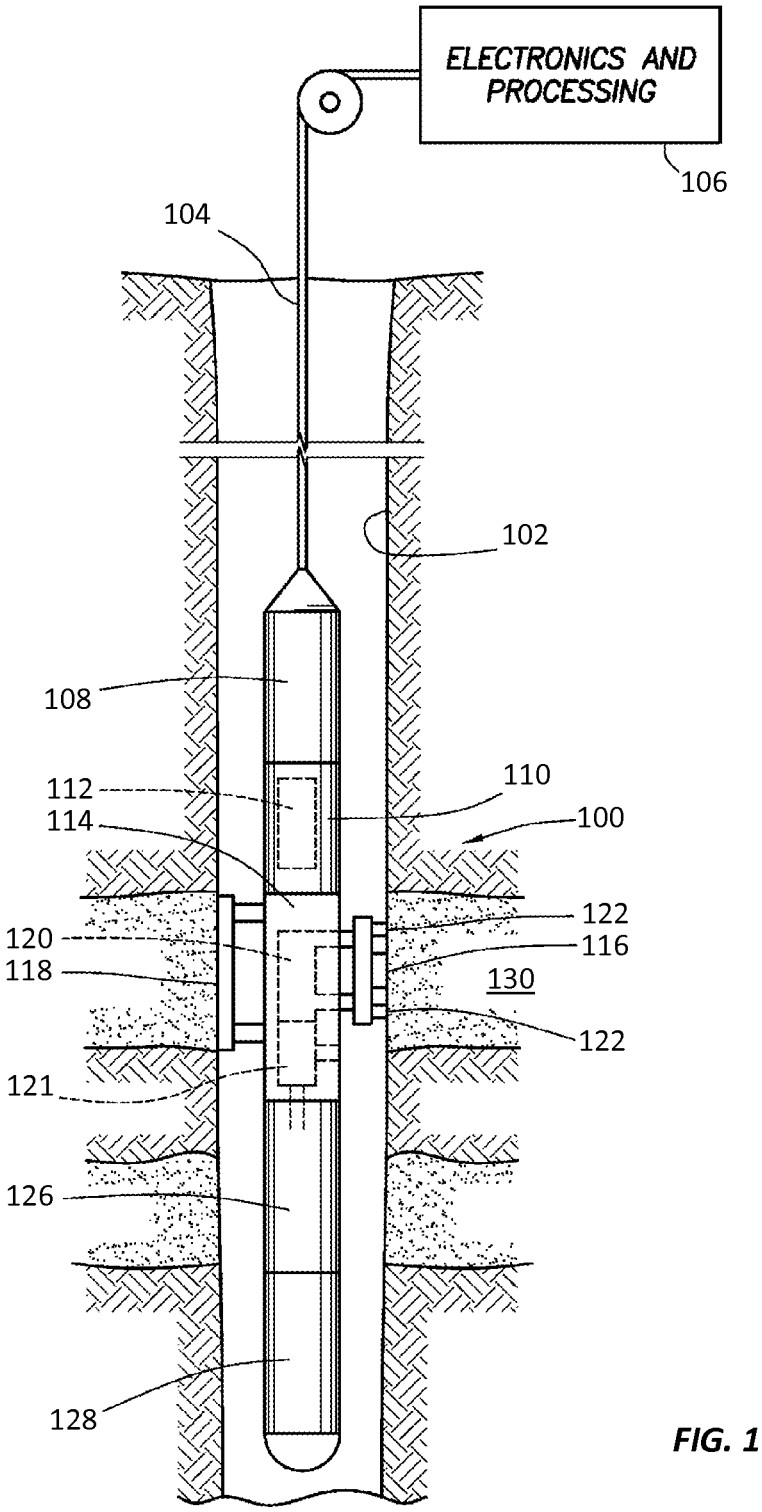
FIG. 1 is a schematic view of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed except where specifically noted as indicating a relationship.

FIG. 1 is a schematic view of an example well site system according to one or more aspects of the present disclosure is shown. The well site, which may be situated onshore or offshore, comprises a wireline tool 100 configured to engage a portion of a sidewall of a borehole 102 penetrating a subterranean formation 130.

The wireline tool 100 may be suspended in the borehole 102 from a lower end of a multi-conductor cable 104 that may be spooled on a winch (not shown) at the Earth's surface. At the surface, the cable 104 may be communicatively coupled to an electronics and processing system 106. The electronics and processing system 106 may include a controller having an interface configured to receive commands from a surface operator. In some cases, the electronics and processing system 106 may further comprise a processor configured to implement one or more aspects of the methods described herein.

The wireline tool 100 may comprise a telemetry module 110, a formation test module 114, and a sample carrier module 126. Although the telemetry module 110 is shown as being implemented separate from the formation test module 114, the telemetry module 110 may be implemented in the formation test module 114. The wireline tool 100 may also comprise additional components at various locations, such as a module 108 above the telemetry module 110 and/or a module 128 below the sample carrier module 126, which may have varying functionality within the scope of the present disclosure.

The formation test module 114 may comprise a selectively extendable probe assembly 116 and a selectively extendable anchoring member 118 that are respectively arranged on opposing sides. The probe assembly 116 may be configured to selectively seal off or isolate selected portions of the sidewall of the borehole 102. For example, the probe assembly 116 may comprise a sealing pad that may be urged against the sidewall of the borehole 102 in a sealing manner to prevent movement of fluid into or out of the formation 130 other than through the probe assembly 116. The probe assembly 116 may thus be configured to fluidly couple a pump 121 and/or other components of the formation tester 114 to the adjacent formation 130. Accordingly, the formation tester 114 may be utilized to obtain fluid samples from the formation 130 by extracting fluid from the formation 130 using the pump 131. A fluid sample may thereafter be expelled through a port (not shown) into the borehole 102, or the sample may be directed to one or more fluid collecting chambers disposed in the sample carrier module 126. In turn, the fluid collecting chambers may receive and retain the formation fluid for subsequent testing at surface or a testing facility.

The formation tester 114 may also be utilized to inject fluid into the formation 130 by, for example, pumping the fluid from one or more fluid collecting chambers disposed in the sample carrier module 126 via the pump 121. Such fluid may be moved from the one or more fluid collecting chambers by applying hydrostatic pressure from within the borehole 102 to a sliding piston disposed in the collecting chamber, in addition to or in substitution of using the pump 121. While the wireline tool 100 is depicted as comprising only one pump 121, it may also comprise multiple pumps. The pump 121 and/or other pumps of the wireline tool 100 may also comprise a reversible pump configured to pump in two directions (e.g., into and out of the formation 130, into and out of the collecting chamber(s) of the sample carrier module 126, etc.).

The probe assembly 116 may comprise one or more sensors 122 adjacent a port of the probe assembly 116, among locations. The sensors 122 may be configured to determine petrophysical parameters of a portion of the formation 130 proximate the probe assembly 116. For example, the sensors 122 may be configured to measure or detect one or more of electric resistivity, dielectric constant, magnetic resonance relaxation time, nuclear radiation, and/or combinations thereof, although other types of sensors are also within the scope of the present disclosure.

The formation tester 114 may also comprise a fluid sensing unit 120 through which obtained fluid samples may flow to measure properties and/or composition data of the sampled fluid. For example, the fluid sensing unit 120 may comprise one or more of a fluorescence sensor, an optical fluid analyzer, a density and/or viscosity sensor, and/or a pressure and/or temperature sensor, among others. The fluid sensing unit 120 and/or the components thereof may be substantially similar or identical to the sensor unit 400 shown in FIG. 4 and described below.

The telemetry module 110 may comprise a downhole control system 112 communicatively coupled to the electronics and processing system 106. The electronics and processing system 106 and/or the downhole control system 112 may be configured to control the probe assembly 116 and/or the extraction of fluid samples from the formation 130, such as via the pumping rate of pump 221. The electronics and processing system 106 and/or the downhole control system 112 may be further configured to analyze and/or process data obtained from sensors disposed in the fluid sensing unit 120 and/or the sensors 122, store measurements or processed data, and/or communicate measurements or processed data to surface or another component for subsequent analysis.

Figure 2:
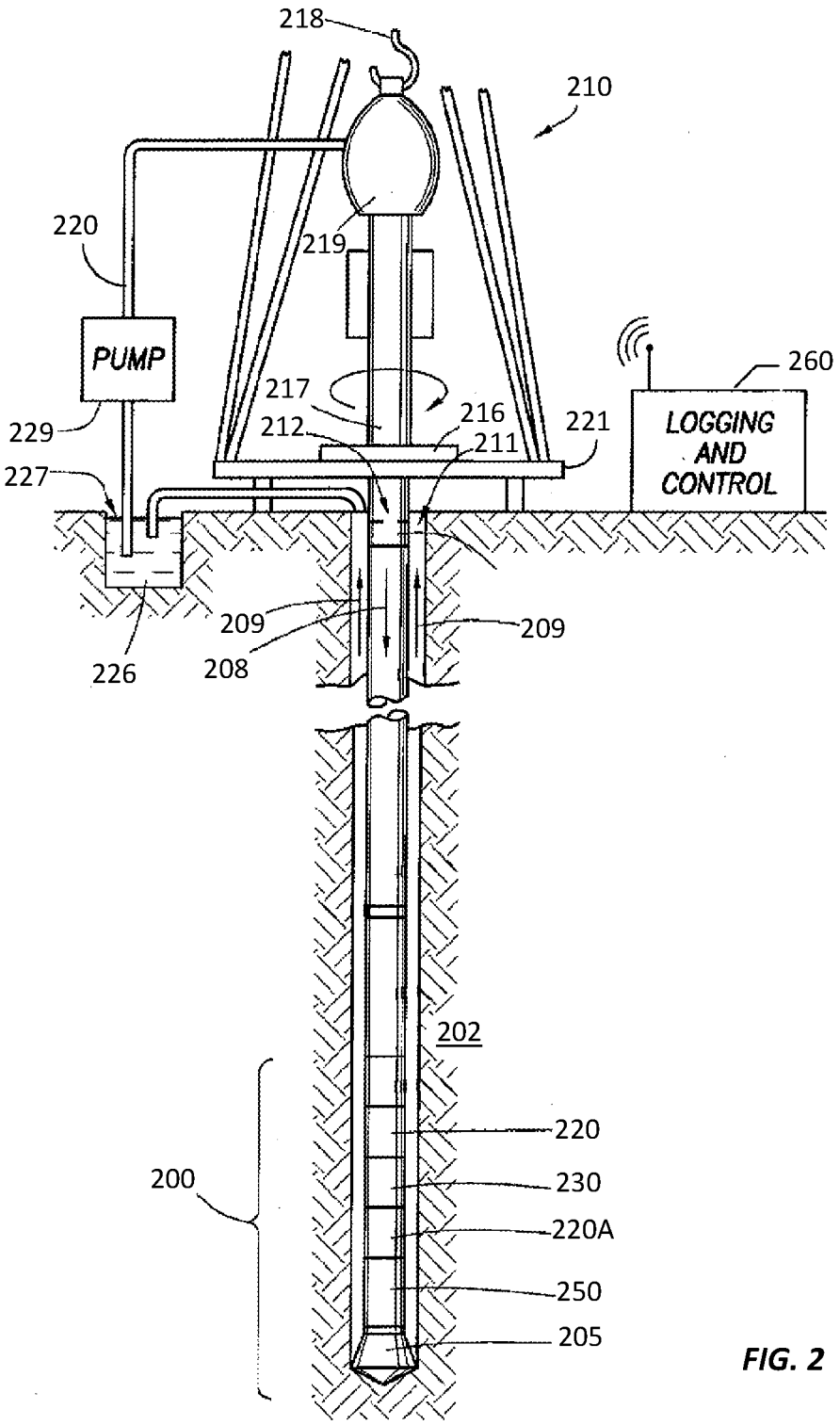
FIG. 2 is a schematic view of apparatus according to one or more aspects of the present disclosure.
Figure 3:
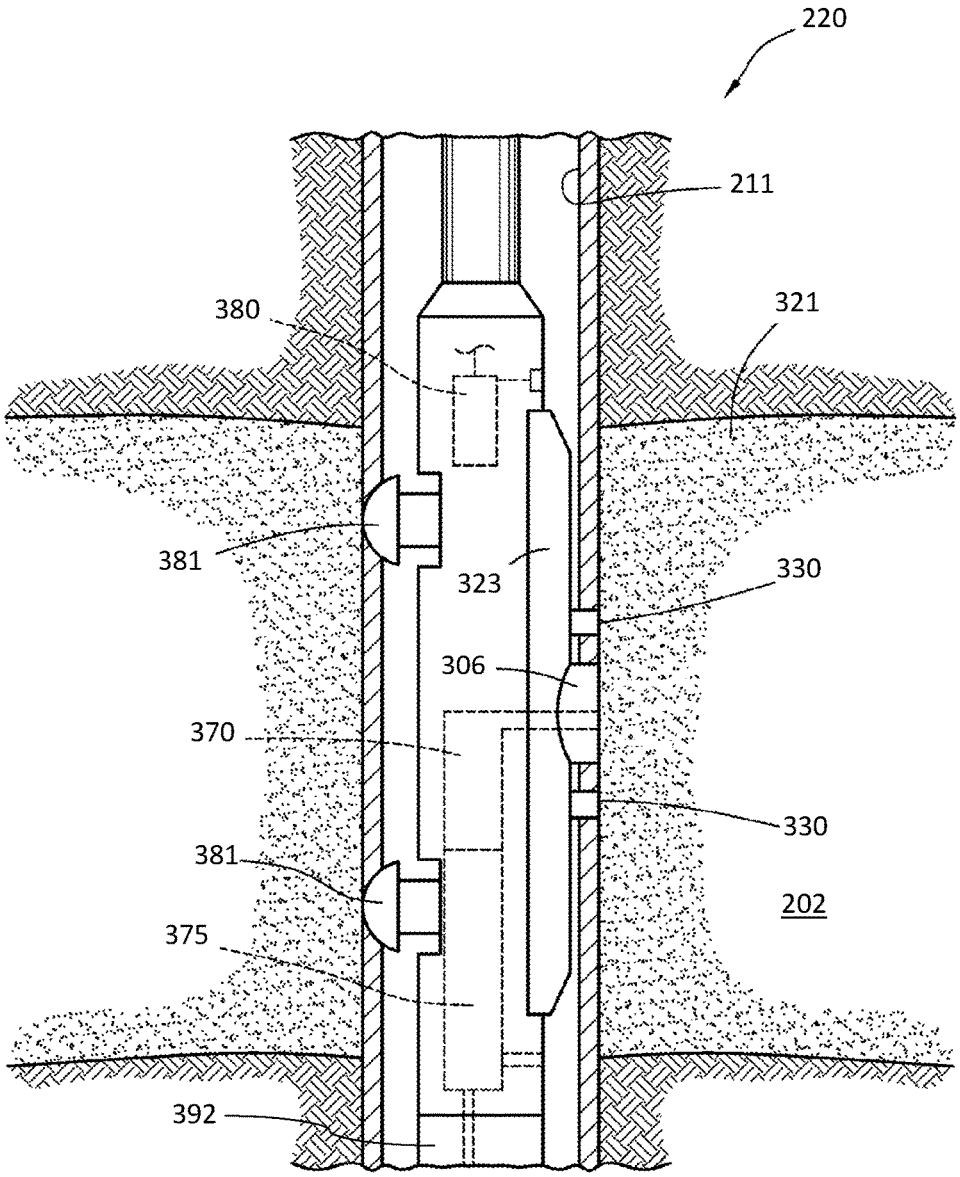
FIG. 3 is a schematic view of apparatus according to one or more aspects of the present disclosure.

FIGS. 2 and 3 are schematic views of another example well site system according to one or more aspects of the present disclosure. The well site may be situated onshore (as shown) or offshore. The system may comprise one or more sampling-while drilling devices 220, 220A that may be configured to seal a portion of the sidewall of a borehole 211 penetrating a subterranean formation 202. The borehole 211 may be drilled through subsurface formations by rotary drilling in a manner that is well known in the art. However, the present disclosure also contemplates others examples used in connection with directional drilling apparatus and methods.

A drill string 212 suspended within the borehole 211 may comprise a bottom hole assembly (BHA) 200 proximate the lower end thereof. The BHA 200 may comprise a drill bit 205 at its lower end. However, the drill bit 205 may be omitted in some operations, such that the bottom hole assembly 200 may be conveyed via tubing or pipe. The surface portion of the well site system may include a platform and derrick assembly 210 positioned over the borehole 211, the assembly 210 comprising a rotary table 216, a kelly 217, a hook 218 and a rotary swivel 219. The drill string 212 may be rotated by the rotary table 216, which is itself operated by well-known means not shown in the drawing. The rotary table 216 may engage the kelly 217 at the upper end of the drill string 212. As is well known, a top drive system (not shown) could alternatively be used instead of the kelly 217 and rotary table 216 to rotate the drill string 212 from the surface. The drill string 212 may be suspended from the hook 218. The hook 218 may be attached to a traveling block (not shown) through the kelly 217 and the rotary swivel 219, which may permit rotation of the drill string 212 relative to the hook 218.

The surface system may comprise drilling fluid (or mud) 226 stored in a tank or pit 227 formed at the well site. A pump 229 may deliver the drilling fluid 226 to the interior of the drill string 212 via a port in the swivel 219, via one or more conduits 225, causing the drilling fluid 226 to flow downwardly through the drill string 212 as indicated by the directional arrow 208. The drilling fluid 226 may exit the drill string 212 via water courses, nozzles, or jets in the drill bit 205, and then may circulate upwardly through the annulus region between the outside of the drill string and the sidewall of the borehole, as indicated by the directional arrows 209. The drilling fluid 226 may lubricate the drill bit 205 and may carry formation cuttings up to the surface, whereupon the drilling fluid 226 may be cleaned and returned to the pit 227 for recirculation.

The bottom hole assembly (BHA) 200 may comprise a logging-while-drilling (LWD) module 220 configured for sampling-while-drilling operations, as well as a measuring-while-drilling (MWD) module 230, and a rotary-steerable directional drilling system and hydraulically operated motor collectively designated by reference numeral 250. The BHA 200 may also comprise the drill bit 205. The LWD module 220 may be housed in a special type of drill collar, as is known in the art, and may contain a plurality of known and/or future-developed types of well logging and/or sampling instruments. It will also be understood that more than one LWD module may be employed, for example, as represented at 220A (references, throughout, to a module at the position of LWD module 220 may alternatively mean a module at the position of LWD module 220A as well). The LWD module 220 may include capabilities for measuring, processing, and storing information, as well as for communicating with the MWD module 230. For example, the LWD module 220 may include one or more processors and/or other controllers configured to implement one or more aspects of the methods described herein. The LWD module 220 may also comprise one or more testing-while-drilling devices such as or similar to the sensor unit 400 shown in FIG. 4 and described below.

The MWD module 230 may also be housed in a special type of drill collar, as is known in the art, and may comprise one or more devices for measuring characteristics of the drill string 212 and/or the drill bit 205. The MWD module 230 may further comprise an apparatus (not shown) for generating electrical power for the downhole portion of the well site system. Such apparatus may comprise a turbine generator powered by the flow of the drilling fluid 226, although other power and/or battery systems may be also or alternatively be utilized. The MWD module 230 may comprise one or more of the following types of measuring devices: a weight-on-bit measuring device, a torque measuring device, a vibration measuring device, a shock measuring device, a stick slip measuring device, a direction measuring device, and an inclination measuring device. The MWD module 230 may further comprise an annular pressure sensor and/or a natural gamma ray sensor. The MWD module 230 may include capabilities for measuring, processing, and storing information, as well as for communicating with a logging and control unit 260, which may have functionality similar to that of the electronics and processing system 106 shown in FIG. 1. For example, the MWD module 230 and the logging and control unit 260 may communicate information (uplinks and/or downlinks) via mud pulse telemetry (MPT) and/or wired drill pipe (WDP) telemetry. The logging and control unit 260 may comprise a controller having an interface configured to receive commands from a surface operator. Thus, commands may be sent to one or more components of the BHA 200, such as to the LWD module 220, among others.

As shown in the simplified example shown in FIG. 3, the LWD module 220 may comprise a stabilizer having one or more blades 323 configured to engage a sidewall of the borehole 211. The LWD module 220 may also comprise one or more backup pistons 381 configured to assist in applying a force to push and/or move the LWD module 220 against the sidewall. A probe assembly 306 may protrude or perhaps extend (e.g., mechanically and/or hydraulically) from the stabilizer blade 323 of the LWD module 220. The probe assembly 306 may be configured to selectively seal off or isolate a portion of the sidewall of the borehole 211, such as to fluidly couple to an adjacent portion of the formation 202. A sealing pad of the probe assembly 306 may be configured to substantially prevent movement of fluid 321 out of the formation 202 other than through the probe assembly 306, such as to fluidly couple a pump 375 and/or other components of the LWD module 220 to the adjacent formation 202. Once the probe assembly 306 fluidly couples to the adjacent formation 202, various measurements may be conducted on the adjacent portion of the formation 202 and/or the fluid therein.

The pump 375 may be operable to draw formation fluid 321 from the formation 202 into the LWD module 220 via the probe assembly 306. The fluid may thereafter be expelled through a port into the borehole 211, or it may be sent to one or more fluid collecting chambers disposed in a sample carrier module 392, which may receive and retain the formation fluid for subsequent testing at another component, the surface or a testing facility. The sample carrier module 392 may be positioned below (as shown in FIG. 3) or above the portion of the LWD module 220 comprising the pump 375. While the LWD module 220 is depicted as comprising only one pump 375, it may also comprise multiple pumps. The pump 375 and/or other pumps of the LWD module 220 also comprise a reversible pump configured to pump in two directions (e.g., into and out of the formation 202, into and out of the collecting chamber(s) of the sample carrier module 392, etc.).

The LWD module 220 may also comprise one or more sensors 330 disposed in the stabilizer blade 323 adjacent a port of the probe assembly 306. The sensors 330 may be utilized to determine one or more petrophysical parameters of the adjacent portion of the formation 202. For example, the sensors 330 may be configured to measure electric resistivity, dielectric constant, magnetic resonance relaxation time, nuclear radiation, and/or combinations thereof, among others.

The LWD module 220 may also comprise a fluid sensing unit 370 through which sampled formation fluid may flow to measure properties and/or composition data thereof. For example, the fluid sensing unit 370 may comprise one or more of a fluorescence sensor, an optical fluid analyzer, a density and/or viscosity sensor, and/or a pressure and/or temperature sensor, among others. The fluid sensing unit 370 and/or the components thereof may be substantially similar or identical to the sensor unit 400 shown in FIG. 4 and described below.

The LWD module 220 may be at least partially controlled by a control system 380 thereof. For example, the control system 380 may be configured to control the extraction of fluid samples from the formation 202 via controlling the pumping rate of the pump 375, among other parameters. The control system 380 may be further configured to analyze and/or process data obtained, for example, from sensors disposed in the fluid sensing unit 370 and/or the sensors 330, store measurement or processed data, and/or communicate measurement or processed data to another component and/or the surface (e.g., to the logging and control unit 260 of FIG. 2) for subsequent analysis.

While the formation tester 114 of FIG. 1 and the LWD module 220 of FIGS. 2 and 3 are depicted as comprising only one probe assembly, they may alternatively comprise multiple probes within the scope of the present disclosure. For example, probes of different inlet sizes, shapes (e.g., elongated inlets), and/or sealing pads may be provided.

Figure 4:
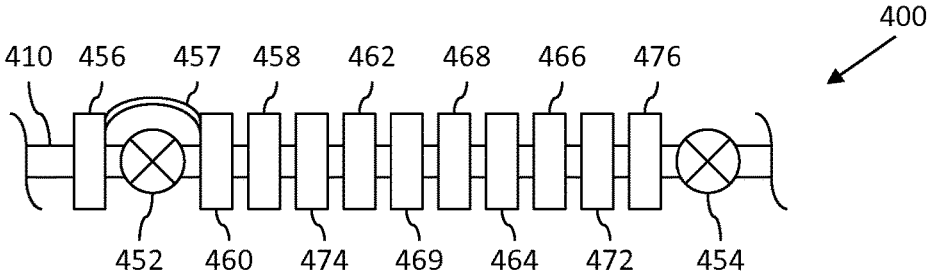
FIG. 4 is a schematic view of apparatus according to one or more aspects of the present disclosure.

FIG. 4 is a schematic view of a sensor unit 400 which may at least partially form or comprise the fluid sensing unit 120 shown in FIG. 1 and/or the fluid sensing unit 370 shown in FIG. 3 according to one or more aspects of the present disclosure. The sensor unit 400 may comprise selectively operable valves 452 and 454 operatively associated with flowlines of the formation tester 114 shown in FIG. 1 and/or the LWD module 220 shown in FIGS. 2 and 3 to control formation fluid flow into and out of the sensor unit 400 via flowline 410. The valves 452 and 454 may also be operable to isolate formation fluids in the flowline 410 between the two valves. The following discussion regards the various sensors and other equipment position on the flowline 410 between the valves 452 and 454.

For example, the sensor unit 400 comprises an optical spectrometer 456 and a refractometer and/or another optical cell (hereafter referred to simply as "refractometer") 460. One or more optical fiber bundles 457 and/or other communication means may couple the spectrometer 456 with the refractometer 460. The sensor unit 400 also comprises a fluorescence detector 458. The spectrometer 456, refractometer 460, and fluorescence detector 457 may be individually and/or collectively utilized to characterize fluids flowing through or retained in the flowline 410, such as in the manner described in U.S. Pat. No. 5,331,156, U.S. Pat. No. 6,476,384, and/or U.S. Pat. No. 7,002,142, each of which are hereby incorporated herein by reference in their entirety.

The sensor unit 400 may also comprise a density sensor 462, one or more pressure and/or temperature sensors 464, and/or other sensors that may be utilized to acquire density, pressure and/or temperature measurements with respect to fluids in the flowline 410. These and/or other density and/or viscosity sensors, such as x-ray sensors, gamma ray sensors, and vibrating rod and/or wire sensors, among others, may be also utilized for fluid characterization within the scope of the present disclosure.

The sensor unit 400 may also comprise a resistivity sensor 474, a chemical sensor 469, and/or other sensors that may be utilized to acquire fluid electrical resistance measurements and/or to detect CO2, H2S, and/or pH, among other chemical properties. Such sensors and/or their utilization may be similar to those described in U.S. Pat. No. 4,860,581, the entirety of which is hereby incorporated herein by reference.

The sensor unit 400 may also comprise an ultrasonic transducer 466 and/or a microelectromechanical (MEMS) density and viscosity sensor 468, which may also be individually and/or collectively be utilized to measure characteristics of formation fluids in the flowline 410. Such sensors and/or their utilization may be similar to those described in U.S. Pat. Nos. 6,758,090 and 7,434,457, the entireties of which are hereby incorporated herein by reference. For example, these sensors 466 and/or 468 may be utilized to detect bubble point pressure, such as may be indicated by or detectable from a variance signal measured by the ultrasonic transducer 466.

The sensor unit 400 may also comprise a scattering detector 476. The scattering detector 476 that may be utilized to monitor phase separation in the fluids in the flowline 410, such as by detecting asphaltene, bubbles, oil mist from gas condensate, and/or other particles. Additionally, or alternatively, the sensor unit 400 may comprise a video imaging system 472 that may comprise a charge coupled device (CCD) and/or other type of camera. The imaging system 472 may be utilized for spectral imaging to characterize phase behavior of fluids in the flowline 410, such as disclosed U.S. Pat. No. 7,933,018, the entirety of which is hereby incorporated herein by reference. For example, the imaging system 472 may be utilized to monitor asphaltene precipitation, bubble break out, and/or liquid separation from gas condensate, among other functions. The imaging system 472 may also be utilized to measure precipitated asphaltene size change when pressure of the fluid in the flowline 410 is decreasing.

The present disclosure introduces inverting downhole fluorescence intensity measurements to estimate asphaltene content. This concept is based on the relationship between fluorescence intensity and asphaltene content, which may be utilized to demonstrate the substantial impact of oil viscosity on fluorescence intensity.

Apparatus within the scope of the present disclosure, including those explicitly described above and shown in FIGS. 1-4, may be configured to collect formation fluid samples and measure fluorescence intensity downhole. Fluorescence intensity measurements involve the interaction of a molecule with an incident photon, which is absorbed by a molecule referred to as a fluorophore. The energy of the photon is then transferred to the fluorophore, which transitions to an excited state. That energy can be dissipated by emitting a photon ("fluorescence") or by chemical reactions ("quenching reactions") that transfer energy to other molecules ("quenchers") and eventually to heat. Fluorescence lifetime is the amount of time for which an excited fluorophore fluoresces before it has relaxed to the ground state.

Fluorescence intensity can be described using the relationship set forth below in Equation (1):

$$\frac{I_f^0}{I_f} = 1 + k_Q \tau_0 [Q] \tag{1}$$

where: $I_f^0$ is fluorescence intensity in the limit where the quencher concentration=0;

$I_f$ is the measured fluorescence intensity;

$k_Q$ is the quenching rate coefficient;

$\tau_0$ is the intrinsic fluorescence lifetime of the fluorophore (quencher concentration=0); and

[Q] is the quencher concentration.

Crude oil may be divided into four classes: saturates, aromatics, resins, and asphaltenes. Saturates generally do not participate in fluorescence. Aromatics and resins are fluorophores but not quenchers, in that they absorb incident photons and emit fluorescent photons, but they do not react with themselves to quench. Asphaltenes are quenchers but not fluorophores, in that they do not fluoresce at concentrations usually found in most crude oil, but they quench fluorescence from resins and aromatics. Accordingly, Equation (1) may be rewritten as set forth below in Equation (2):

$$\frac{I_f^0}{I_f} = 1 + k_Q \tau_0 [A] \tag{2}$$

where [A] is the concentration of asphaltenes.

Therefore, the fluorescence intensity measured downhole at multiple depths can be related to the asphaltene content at those depths as set forth below in Equation (3);

$$I_f^{-1} = \alpha[1+\beta[A]] \tag{3}$$

where: $\alpha$ is a fitting parameter and $\beta$[A] is the relative asphaltene content.

Therefore, the relative asphaltene content can be found from fluorescence measurements, assuming that $\alpha$ and $\beta$ are both constant downhole. However, as described above, asphaltene content [A] is not constant in heavy oil reservoirs.

In Equation (3), the fitting parameter $\alpha$ can be defined as $1/I_f^0$, which is an inherent property of the maltene fraction of the crude oil. Maltene is the resinous component that remains when the asphaltenes are removed. The composition of the maltene fraction of crude oil generally doesn't change in connected reservoirs, such that the assumption of a constant fitting parameter $\alpha$ is valid.

The parameter $\beta$ can be defined as $k_Q\tau_0$. The intrinsic fluorescence lifetime of the fluorophore, $\tau_0$, is also an inherent property of the maltenes and, therefore, can be considered to be constant downhole. However, the rate at which excited molecules are quenched, $k_Q$, is not constant throughout the reservoir. Instead, the rate of quenching is dependent upon the diffusion rate of the crude oil. Quenching rates are often diffusion-limited when the quencher concentration is high, and heavy oils are concentrated quenchers. Thus, quenching in heavy oils is also diffusion-limited. The quenching rate for diffusion-limited quenching can be expressed as set forth below in Equation (4):

$$k_Q = \frac{8RT}{3\eta} \tag{4}$$

where: R is the universal gas constant;

T is the temperature; and $\eta$ is the viscosity.

Accordingly, Equation (3) can be rewritten as set forth below in Equation (5):

$$I_f^{-1} = \alpha\left[1 + \frac{\beta'}{\eta}[A]\right] \tag{5}$$

where:

$$\beta' \equiv \frac{8RT\tau_0}{3}$$

and $\alpha \equiv 1/I_f^0$.

In contrast to Equation (3), Equation (5) may be utilized where viscosity gradients exist, because the viscosity is accounted for directly. However, utilizing Equation (5) to determine the relative asphaltene content is based on the assumption that there exists an estimate of the viscosity of the fluid, or at least an estimate of the relative viscosity differences between two fluids.

There are several ways to determine this additional viscosity information. For example, the viscosity may be directly measured downhole, such as by one or more of the sensors described above, including viscosity sensors comprising a vibrating rod and/or wire. The viscosity may alternatively or additionally be estimated from related downhole logs, such as a related nuclear magnetic resistance (NMR) log.

However, where no viscosity measurement or logging estimate is available, the viscosity may be estimated from the composition of the fluid. For example, the viscosity of crude oil is related to its asphaltene content as set forth below in Equation (6):

$$\eta = \frac{\eta_m}{(1 - K'[A])^{\nu}} \tag{6}$$

where: $\eta$ is the viscosity of oil;

$\eta_m$ is the viscosity of free maltene, which can be considered constant; and K' and $\nu$ are constants.

Values near K'=1.88 and $\nu$=6.9 have been experimentally shown to be appropriate for black oils and heavy oils having viscosities ranging between 10-$10^8$ cP, however, other values may also be within the scope of the present disclosure. Accordingly, Equation (6) can be substituted into Equation (5) to determine the relationship between measured fluorescence intensity and asphaltene concentration, as set forth below in Equation (7):

$$I_f^{-1} = \alpha\left[1 + \frac{\beta'}{\eta_m}(1 - K'[A])^{\nu}[A]\right] \tag{7}$$

And since K' and $\nu$ are known, Equation (7) can be rewritten as set forth below in Equation (8):

$$I_f^{-1}=\alpha[1+\beta''(1-K'[A])^{\nu}[A]] \tag{8}$$

where the measured fluorescence intensity $I_f$ is related to the asphaltene content [A] by the known parameters K' and $\nu$, one constant that cancels in the ratio between fluorescence intensities at two different stations $\alpha$, and one fitting constant assumed $$\beta'' \equiv \frac{8RT\tau_0}{3\eta_m}.$$

From the above, there are two equations the account for variations in viscosity and can be utilized to interpret downhole fluorescence measurements to estimate relative asphaltene context in heavy oil reservoirs. That is, Equation (5) can be utilized where viscosity is known independently from a vibrating rod or wire sensor or an NMR log, and Equation (8) can be utilized where no independent measure of viscosity is available, based on the assumption that viscosity can be described by an equation relating it to asphaltene content. In each case, the asphaltene content of one sample is known or assumed, and then this equation can be utilized to estimate asphaltene content of other samples from the fluorescence intensity data. Thus, when an external measurement of viscosity is available, the fluorescence intensity can be related to asphaltene content by Equation (5). In practice, the fitting constant $\alpha$ may be multiplied by a geometric factor representing the fraction of fluorescent photons that can be detected given the geometry, detector efficiency, and/or other aspects of the downhole tool and/or sensors. However, the value of $\alpha$ may be inconsequential, because this parameter cancels when finding the ratio of two fluorescence signals. When no external measurement of viscosity is available, the fluorescence intensity can be related to asphaltene content by Equation (8). A practical example of Equation (8) is set forth below as Equation (9):

$$I_f^{-1}=\alpha[1+\beta''(1-1.88'[A])^{6.9}[A]] \tag{9}$$

where:

$$\beta' \equiv \frac{8RT\tau_0}{3\eta_m}$$

and $\alpha \equiv 1/I_f^0$.

Figure 5:
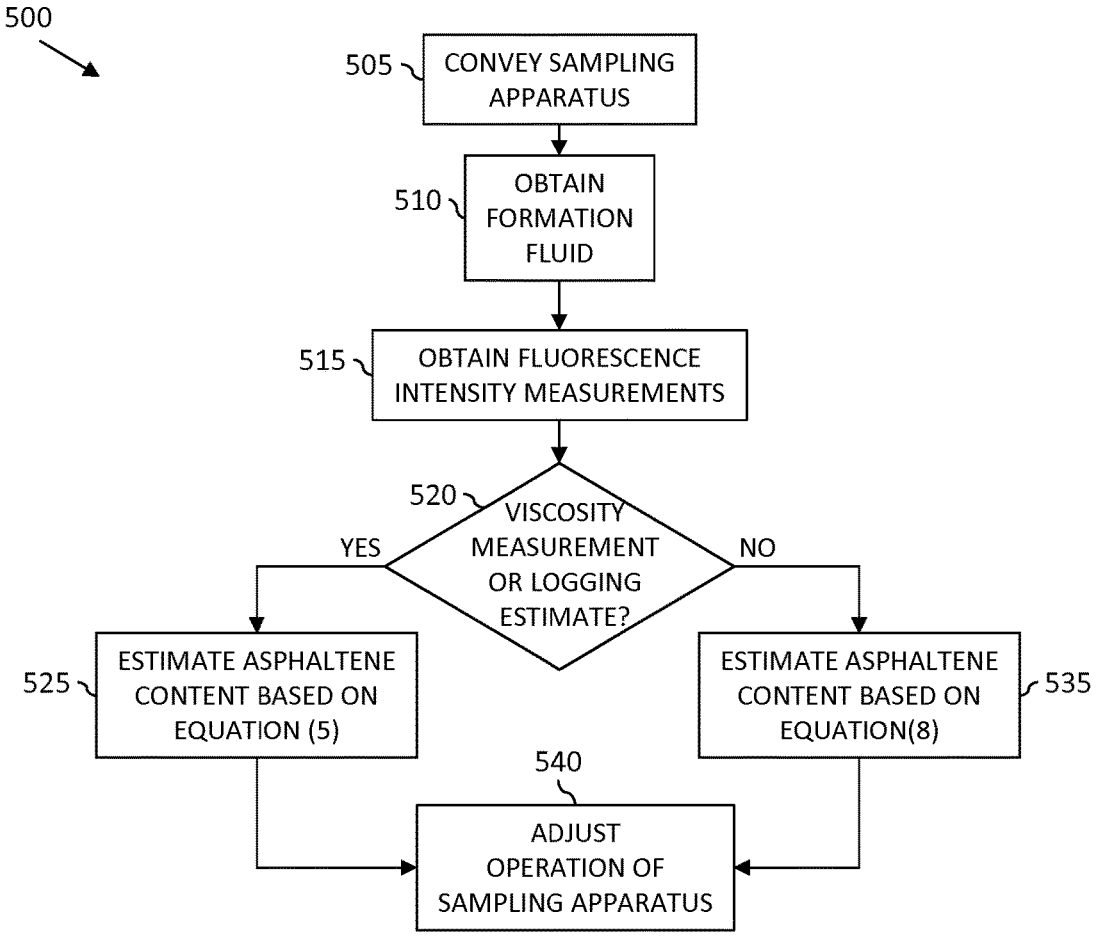
FIG. 5 is a flow-chart diagram of at least a portion of a method according to one or more aspects of the present disclosure.

FIG. 5 is a flow-chart diagram of a method 500 according to one or more aspects of the present disclosure. The method 500 is one example of the implementation of the concepts described above, although other examples are also within the scope of the present disclosure. The method 500 may be performed by apparatus as described above and shown in FIGS. 1-4, and other apparatus within the scope of the present disclosure.

The method 500 may comprise conveyance 505 of a downhole sampling apparatus within a borehole extending into a subterranean formation of interest. The sampling apparatus may be or comprise at least a portion of the wireline tool 100 shown in FIG. 1 and/or the LWD module 220 shown in FIGS. 2 and 3, and the conveyance may be via wireline and/or drillstring. However, downhole sampling apparatus other than those shown in FIGS. 1-3 may also be within the scope of the present disclosure, as well as conveyance means other than wireline and drillstring. The subterranean formation may comprise heavy oil(s), although one or more aspects of the present disclosure may also be applicable or readily adaptable for utilization in formations containing other types of crude oil.

The method 500 also comprises obtaining 510 fluid from the subterranean formation. For example, the probe assembly 116 shown in FIG. 1 may be urged into sealing contact with the sidewall of the borehole, such that subsequent operation of the pump 121 may draw fluid from the formation into the tool 100. Similarly, the probe assembly 306 shown in FIG. 3 may be urged into sealing contact with the sidewall of the borehole, such that subsequent operation of the pump 375 may draw fluid from the formation into the module 220. Other means for obtaining a formation fluid sample are also within the scope of the present disclosure.

Fluorescence intensity measurements of the obtained formation fluid sample may then be obtained 515, such as via operation of the sensor unit 400 shown in FIG. 4. Other means for obtaining fluorescence intensity measurements are also within the scope of the present disclosure.

The method 500 also comprises a determination 520 of whether viscosity has been directly measured or can be estimated from NMR and/or other logs. If such viscosity measurement(s) and/or logging estimate(s) exist, the asphaltene content may then be estimated 525 utilizing Equation (5) above. If no external viscosity measurement or logging estimate exists, the asphaltene content may then be estimated 535 utilizing Equation (8) (or Equation (9)) above.

The method 500 may also comprise performing one or more adjustments 540 of an operational parameter of the downhole sampling apparatus based on the asphaltene content estimation 525/535. For example, such adjustment(s) 540 may comprise initiating storage of a sample of the formation fluid flowing through the downhole sampling tool, and/or adjusting a rate of pumping of formation fluid into the downhole sampling tool based, among other operational adjustments and/or other actions within the scope of the present disclosure.

Figure 6:
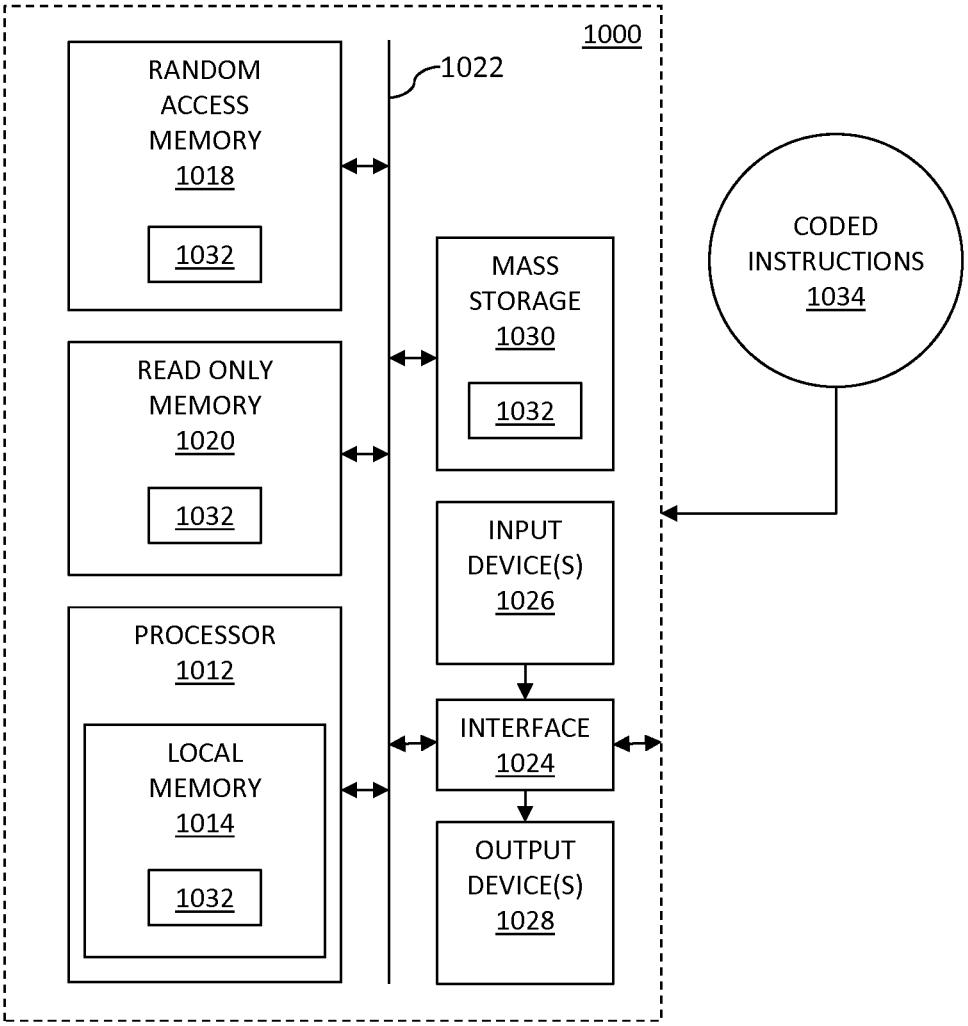
FIG. 6 is a schematic view of apparatus according to one or more aspects of the present disclosure.

FIG. 6 is a block diagram of an example processing system 1000 that may execute example machine-readable instructions used to implement one or more of the methods and/or processes described herein, and/or to implement the example downhole tools described herein. The processing system 1000 may be or comprise, for example, one or more processors, one or more controllers, one or more special-purpose computing devices, one or more servers, one or more personal computers, one or more personal digital assistant (PDA) devices, one or more smartphones, one or more internet appliances, and/or any other type(s) of computing device(s). Moreover, while it is possible that the entirety of the system 1000 shown in FIG. 6 is implemented within the downhole tool, it is also contemplated that one or more components or functions of the system 1000 may be implemented in surface equipment, including the surface equipment described above.

The system 1000 comprises a processor 1012 such as, for example, a general-purpose programmable processor. The processor 1012 includes a local memory 1014, and executes coded instructions 1032 present in the local memory 1014 and/or in another memory device. The processor 1012 may execute, among other things, machine-readable instructions to implement the methods and/or processes described herein. The processor 1012 may be, comprise or be implemented by any type of processing unit, such as one or more INTEL microprocessors, one or more microcontrollers from the ARM and/or PICO families of microcontrollers, one or more embedded soft/hard processors in one or more FPGAs, etc. Of course, other processors from other families are also appropriate.

The processor 1012 is in communication with a main memory including a volatile (e.g., random access) memory 1018 and a non-volatile (e.g., read only) memory 1020 via a bus 1022. The volatile memory 1018 may be, comprise or be implemented by static random access memory (SRAM), synchronous dynamic random access memory (SDRAM), dynamic random access memory (DRAM), RAMBUS dynamic random access memory (RDRAM) and/or any other type of random access memory device. The non-volatile memory 1020 may be, comprise or be implemented by flash memory and/or any other desired type of memory device. One or more memory controllers (not shown) may control access to the main memory 1018 and/or 1020.

The processing system 1000 also includes an interface circuit 1024. The interface circuit 1024 may be, comprise or be implemented by any type of interface standard, such as an Ethernet interface, a universal serial bus (USB) and/or a third generation input/output (3GIO) interface, among others.

One or more input devices 1026 are connected to the interface circuit 1024. The input device(s) 1026 permit a user to enter data and commands into the processor 1012. The input device(s) may be, comprise or be implemented by, for example, a keyboard, a mouse, a touchscreen, a track-pad, a trackball, an isopoint and/or a voice recognition system, among others.

One or more output devices 1028 are also connected to the interface circuit 1024. The output devices 1028 may be, comprise or be implemented by, for example, display devices (e.g., a liquid crystal display or cathode ray tube display (CRT), among others), printers and/or speakers, among others. Thus, the interface circuit 1024 may also comprise a graphics driver card.

The interface circuit 1024 also includes a communication device such as a modem or network interface card to facilitate exchange of data with external computers via a network (e.g., Ethernet connection, digital subscriber line (DSL), telephone line, coaxial cable, cellular telephone system, satellite, etc.).

The processing system 1000 also includes one or more mass storage devices 1030 for storing machine-readable instructions and data. Examples of such mass storage devices 1030 include floppy disk drives, hard drive disks, compact disk drives and digital versatile disk (DVD) drives, among others.

The coded instructions 1032 may be stored in the mass storage device 1030, the volatile memory 1018, the non-volatile memory 1020, the local memory 1014 and/or on a removable storage medium, such as a CD or DVD 1034.

As an alternative to implementing the methods and/or apparatus described herein in a system such as the processing system of FIG. 6, the methods and or apparatus described herein may be embedded in a structure such as a processor and/or an ASIC (application specific integrated circuit).

In view of the entirety of the present disclosure, including FIGS. 1-6, a person of ordinary skill in the art will readily recognize that the present disclosure introduces a method comprising: conveying a downhole tool within a borehole extending into a subterranean formation, wherein the subterranean formation comprises a fluid of varying viscosity; drawing fluid from the subterranean formation into the downhole tool; measuring fluorescence intensity of the drawn fluid via a sensor of the downhole tool; and estimating asphaltene content of the drawn fluid based on the measured fluorescence intensity. Conveying the downhole tool within the borehole may be via wireline or tubular string. The fluid may comprise hydrocarbons, heavy oil, an asphaltene content of at least about 2% by weight, and/or a minimum viscosity of about 1500 cP. Fluorescence intensity and asphaltene content may not be linearly dependent.

Estimating asphaltene content of the drawn fluid may utilize a relationship between fluorescence intensity and asphaltene content given by $$I_f^{-1} = \alpha\left[1 + \frac{\beta'}{\eta}[A]\right]$$

where: $I_f$ is the measured fluorescence intensity; $\alpha$ is a fitting parameter; $\beta'$ is defined as $(8RT\tau_0)/3$; R is the universal gas constant; T is temperature of the drawn fluid; $\tau_0$ is intrinsic fluorescence lifetime; $\eta$ is the viscosity; and [A] is the asphaltene content.

Estimating asphaltene content of the drawn fluid may utilize a relationship between fluorescence intensity and asphaltene content given by $I_f^{-1}=\alpha[1+\beta''(1-K'[A])^{\nu}[A]]$ wherein: $I_f$ is the measured fluorescence intensity; $\alpha$ is a fitting parameter; $\beta''$ is a parameter defined as $8RT\tau_0/(3\eta_m)$; R is the universal gas constant; T is temperature of the drawn fluid; $\tau_0$ is intrinsic fluorescence lifetime; K' is a constant; [A] is the asphaltene content; and $\nu$ is a constant. The value of K' may be about 1.88. The value of $\nu$ may be about 6.9.

Estimating asphaltene content of the drawn fluid based on the measured fluorescence intensity may be performed downhole by the downhole tool. The method may further comprise transmitting information regarding the estimated asphaltene content from the downhole tool to equipment at the Earth's surface in communication with the downhole tool.

The method may further comprise measuring viscosity of the drawn fluid via an additional sensor of the downhole tool, and estimating asphaltene content of the drawn fluid may be further based on the measured viscosity.

The method may further comprise estimating viscosity of the drawn fluid based on previously obtained logging data associated with the subterranean formation, and estimating asphaltene content of the drawn fluid may be further based on the estimated viscosity.

The method may further comprise determining whether viscosity of the drawn fluid has been measured, wherein: if viscosity of the drawn fluid has been measured, estimating asphaltene content of the drawn fluid may be further based on the measured viscosity; and if viscosity of the drawn fluid has not been measured, the method may further comprise estimating viscosity of the drawn fluid based on previously obtained logging data associated with the subterranean formation, and estimating asphaltene content of the drawn fluid may be further based on the estimated viscosity.

The method may further comprise estimating viscosity of the drawn fluid based on the measured fluorescence intensity, and estimating asphaltene content of the drawn fluid may be further based on the estimated viscosity.

The method may further comprise determining whether viscosity of the drawn fluid has been measured, wherein: if viscosity of the drawn fluid has been measured, estimating asphaltene content of the drawn fluid may be further based on the measured viscosity; and if viscosity of the drawn fluid has not been measured, the method may further comprise estimating viscosity of the drawn fluid based on the measured fluorescence intensity, and estimating asphaltene content of the drawn fluid may be further based on the estimated viscosity.

The method may further comprise adjusting an operational parameter of the downhole tool based on the estimated asphaltene content.

The method may further comprise: directing the drawn fluid into a sample chamber of the downhole tool based on the estimated asphaltene content; and retrieving the downhole tool from the borehole to the Earth's surface and then withdrawing the fluid from the sample chamber.

The method may further comprise adjusting an operational parameter of a pump of the downhole tool based on the estimated asphaltene content.

The present disclosure also introduces a method, comprising: conveying a downhole tool within a borehole extending into a subterranean formation, wherein fluorescence intensity and asphaltene content of fluid within the subterranean formation are not linearly dependent; drawing fluid from the subterranean formation into the downhole tool; measuring fluorescence intensity of the drawn fluid via a sensor of the downhole tool; and estimating asphaltene content of the drawn fluid based on the measured fluorescence intensity. The fluid may comprise hydrocarbons, heavy oil, heavy oil having an asphaltene content of at least about 2% by weight, and/or heavy oil having a minimum viscosity of about 1500 cP. The viscosity of the subterranean formation fluid may vary. Conveying the downhole tool within the borehole may be via wireline or tubular string.

Estimating asphaltene content of the drawn fluid may utilize a relationship between fluorescence intensity and asphaltene content given by $$I_f^{-1} = \alpha\left[1 + \frac{\beta'}{\eta}[A]\right]$$

where: $I_f$ is the measured fluorescence intensity; $\alpha$ is a fitting parameter; $\beta'$ is defined as $(8RT\tau_0)/3$; R is the universal gas constant; T is temperature of the drawn fluid; $\tau_0$ is intrinsic fluorescence lifetime; $\eta$ is the viscosity; and [A] is the asphaltene content.

Estimating asphaltene content of the drawn fluid may utilize a relationship between fluorescence intensity and asphaltene content given by $I_f^{-1}=\alpha[1+\beta''(1-K'[A])^{\nu}[A]]$ wherein: $I_f$ is the measured fluorescence intensity; $\alpha$ is a fitting parameter; $\beta''$ is a parameter defined as $8RT\tau_0/(3\eta_m)$; R is the universal gas constant; T is temperature of the drawn fluid; $\tau_0$ is intrinsic fluorescence lifetime; K' is a constant; [A] is the asphaltene content; and $\nu$ is a constant. The value of K' may be about 1.88. The value of $\nu$ may be about 6.9.

Estimating asphaltene content of the drawn fluid based on the measured fluorescence intensity may be performed downhole by the downhole tool. The method may further comprise transmitting information regarding the estimated asphaltene content from the downhole tool to equipment at the Earth's surface in communication with the downhole tool.

The method may further comprise measuring viscosity of the drawn fluid via an additional sensor of the downhole tool, and estimating asphaltene content of the drawn fluid may be further based on the measured viscosity.

The method may further comprise estimating viscosity of the drawn fluid based on previously obtained logging data associated with the subterranean formation, and estimating asphaltene content of the drawn fluid may be further based on the estimated viscosity.

The method may further comprise determining whether viscosity of the drawn fluid has been measured, wherein: if viscosity of the drawn fluid has been measured, estimating asphaltene content of the drawn fluid may be further based on the measured viscosity; and if viscosity of the drawn fluid has not been measured, the method may further comprise estimating viscosity of the drawn fluid based on previously obtained logging data associated with the subterranean formation, wherein estimating asphaltene content of the drawn fluid may be further based on the estimated viscosity.

The method may further comprise estimating viscosity of the drawn fluid based on the measured fluorescence intensity, and estimating asphaltene content of the drawn fluid may be further based on the estimated viscosity.

The method may further comprise determining whether viscosity of the drawn fluid has been measured, wherein: if viscosity of the drawn fluid has been measured, estimating asphaltene content of the drawn fluid may be further based on the measured viscosity; and if viscosity of the drawn fluid has not been measured, the method may further comprise estimating viscosity of the drawn fluid based on the measured fluorescence intensity, wherein estimating asphaltene content of the drawn fluid may be further based on the estimated viscosity.

The method may further comprise adjusting an operational parameter of the downhole tool based on the estimated asphaltene content.

The method may further comprising: directing the drawn fluid into a sample chamber of the downhole tool based on the estimated asphaltene content; and retrieving the downhole tool from the borehole to the Earth's surface and then withdrawing the fluid from the sample chamber.

The method may further comprise adjusting an operational parameter of a pump of the downhole tool based on the estimated asphaltene content.

The present disclosure also introduces an apparatus comprising: a downhole tool conveyable within a borehole extending into a subterranean formation, wherein the downhole tool comprises: a probe operable to sealing engage a sidewall of the borehole; a pump operable to draw fluid from the subterranean formation into the downhole tool via the probe while the probe is sealingly engaged with the borehole sidewall; a sensor operable to obtain measurements of fluorescence intensity of the drawn fluid; and a controller operable to estimate asphaltene content of the drawn fluid based on the measured fluorescence intensity utilizing a non-linear relationship between asphaltene content and fluorescence intensity. The drawn fluid may comprise hydrocarbons, heavy oil, heavy oil having an asphaltene content of at least about 2% by weight, and/or heavy oil having a minimum viscosity of about 1500 cP. The viscosity of the drawn fluid may vary within the subterranean formation.

The non-linear relationship between fluorescence intensity and asphaltene content may be given by $$I_f^{-1} = \alpha\left[1 + \frac{\beta'}{\eta}[A]\right]$$

where: $I_f$ is the measured fluorescence intensity; $\alpha$ is a fitting parameter; $\beta'$ is defined as $(8RT\tau_0)/3$; R is the universal gas constant; T is temperature of the drawn fluid; $\tau_0$ is intrinsic fluorescence lifetime; $\eta$ is the viscosity; and [A] is the asphaltene content.

The non-linear relationship between fluorescence intensity and asphaltene content may be given by $I_f^{-1}=\alpha[1+\beta''(1-K'[A])^{\nu}[A]]$ wherein: $I_f$ is the measured fluorescence intensity; $\alpha$ is a fitting parameter; $\beta''$ is a parameter defined as $8RT\tau_0/(3\eta_m)$; R is the universal gas constant; T is temperature of the drawn fluid; $\tau_0$ is intrinsic fluorescence lifetime; K' is a constant; [A] is the asphaltene content; and $\nu$ is a constant. The value of K' may be about 1.88. The value of $\nu$ may be about 6.9.

The downhole tool may be conveyable within the borehole via wireline or tubular string.

The downhole tool may further comprise an additional sensor operable to obtain measurements of viscosity of the drawn fluid, and the controller may be operable to estimate asphaltene content of the drawn fluid based on the measured fluorescence intensity and the measured viscosity.

The controller may be further operable to: store information regarding previously obtained logging data associated with the subterranean formation; estimate viscosity of the drawn fluid based on the stored logging data; and estimate asphaltene content of the drawn fluid based on the measured fluorescence intensity and the estimated viscosity.

The controller may be further operable to: estimate viscosity of the drawn fluid; and estimate asphaltene content of the drawn fluid based on the measured fluorescence intensity and the estimated viscosity. The controller may be further operable to estimate viscosity of the drawn fluid based on the measured fluorescence intensity. The controller may be further operable to estimate viscosity of the drawn fluid based on previously obtained logging data associated with the subterranean formation. The controller may be further operable to store the previously obtained logging data associated with the subterranean formation.

The controller may be further operable to determine whether viscosity of the drawn fluid has been measured and: if viscosity of the drawn fluid has been measured, estimate asphaltene content of the drawn fluid based on the measured fluorescence intensity and the measured viscosity; and if viscosity of the drawn fluid has not been measured, estimate viscosity of the drawn fluid and estimate asphaltene content of the drawn fluid based on the measured fluorescence intensity and the estimated viscosity. The controller may be further operable to estimate viscosity of the drawn fluid based on the measured fluorescence intensity. The controller may be further operable to estimate viscosity of the drawn fluid based on previously obtained logging data associated with the subterranean formation. The controller may be further operable to store the previously obtained logging data associated with the subterranean formation.

The controller may be further operable to adjust an operational parameter of the downhole tool based on the estimated asphaltene content.

The controller may be further operable to direct the drawn fluid into a sample chamber of the downhole tool based on the estimated asphaltene content.

The controller may be further operable to adjust an operational parameter of a pump of the downhole tool based on the estimated asphaltene content.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same aspects of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

What is claimed is:

1. A method, comprising:

conveying a downhole tool within a borehole extending into a subterranean formation, wherein the subterranean formation comprises a fluid of varying viscosity;

drawing fluid from the subterranean formation into the downhole tool;

measuring fluorescence intensity of the drawn fluid via a sensor of the downhole tool; and estimating asphaltene content of the drawn fluid based on the measured fluorescence intensity utilizing a relationship between fluorescence intensity and asphaltene content given by:

$$I_f^{-1} = \alpha\left[1 + \frac{\beta'}{\eta}[A]\right];$$

wherein:

$I_f$ is the measured fluorescence intensity;

$\alpha$ is a fitting parameter;

$\beta'$ is a parameter defined as: $(8RT\tau_0)/3$;

R is the universal gas constant;

T is temperature of the drawn fluid;

$\tau_0$ is intrinsic fluorescence lifetime;

$\eta$ is the viscosity; and

[A] is the asphaltene content.

2. The method of claim 1 wherein the fluid comprises hydrocarbons.

3. The method of claim 1 wherein the fluid comprises heavy oil.

4. The method of claim 1 wherein the fluid comprises heavy oil having an asphaltene content of at least about 2% by weight.

5. The method of claim 1 wherein the fluid comprises heavy oil having a minimum viscosity of about 1500 cP.

6. The method of claim 1 wherein conveying the downhole tool within the borehole is via wireline or tubular string.

7. The method of claim 1 wherein estimating asphaltene content of the drawn fluid based on the measured fluorescence intensity is performed downhole by the downhole tool.

8. The method of claim 7 further comprising transmitting information regarding the estimated asphaltene content from the downhole tool to equipment at the Earth's surface in communication with the downhole tool.

9. The method of claim 1 further comprising measuring viscosity of the drawn fluid via an additional sensor of the downhole tool, wherein estimating asphaltene content of the drawn fluid is further based on the measured viscosity.

10. The method of claim 1 further comprising estimating viscosity of the drawn fluid based on previously obtained logging data associated with the subterranean formation, wherein estimating asphaltene content of the drawn fluid is further based on the estimated viscosity.

11. The method of claim 1 further comprising determining whether viscosity of the drawn fluid has been measured, wherein:

if viscosity of the drawn fluid has been measured, estimating asphaltene content of the drawn fluid is further based on the measured viscosity; and if viscosity of the drawn fluid has not been measured, the method further comprises estimating viscosity of the drawn fluid based on previously obtained logging data associated with the subterranean formation, wherein estimating asphaltene content of the drawn fluid is further based on the estimated viscosity.

12. The method of claim 1 further comprising estimating viscosity of the drawn fluid based on the measured fluorescence intensity, wherein estimating asphaltene content of the drawn fluid is further based on the estimated viscosity.

13. The method of claim 1 further comprising determining whether viscosity of the drawn fluid has been measured, wherein:

if viscosity of the drawn fluid has been measured, estimating asphaltene content of the drawn fluid is further based on the measured viscosity; and if viscosity of the drawn fluid has not been measured, the method further comprises estimating viscosity of the drawn fluid based on the measured fluorescence intensity, wherein estimating asphaltene content of the drawn fluid is further based on the estimated viscosity.

14. The method of claim 1 further comprising adjusting an operational parameter of the downhole tool based on the estimated asphaltene content.

15. The method of claim 1 further comprising:

directing the drawn fluid into a sample chamber of the downhole tool based on the estimated asphaltene content; and retrieving the downhole tool from the borehole to the Earth's surface and then withdrawing the fluid from the sample chamber.

16. The method of claim 1 further comprising adjusting an operational parameter of a pump of the downhole tool based on the estimated asphaltene content.

17. A method, comprising:

conveying a downhole tool within a borehole extending into a subterranean formation, wherein the subterranean formation comprises a fluid of varying viscosity;

drawing fluid from the subterranean formation into the downhole tool;

measuring fluorescence intensity of the drawn fluid via a sensor of the downhole tool; and estimating asphaltene content of the drawn fluid based on the measured fluorescence intensity utilizing a relationship between fluorescence intensity and asphaltene content given by:

$$I_f^{-1}=\alpha[1+\beta''(1-K'[A])^{\nu}[A]],$$

wherein:

$I_f$ is the measured fluorescence intensity;

$\alpha$ is a fitting parameter;

$\beta''$ is a parameter defined as: $8RT\tau_0/(3\eta_m)$;

R is the universal gas constant;

T is temperature of the drawn fluid;

$\tau_0$ is intrinsic fluorescence lifetime;

K' is a constant;

[A] is the asphaltene content;

$\nu$ is a constant; and $\eta_m$ is the viscosity of free maltine.

18. The method of claim 17 wherein K' may have a value of about 1.88 and $\nu$ may have a value of about 6.9.

* * * * *